US005208433A

United States Patent [19]

Hellegouarc'h et al.

[11] Patent Number: 5,208,433

[45] Date of Patent: May 4, 1993

[54] INDUCTIVE HEATING COIL

[75] Inventors: Jean Hellegouarc'h, Le Perreux Sur Marne; Gérard Prost, Fresnes, both of France

[73] Assignee: Rotelec S. A., Bagnolet, France

[21] Appl. No.: 715,192

[22] Filed: Jun. 14, 1991

[30] Foreign Application Priority Data

Jun. 15, 1990 [FR] France ..... 90 07507

[51] Int. Cl.[5] ..... H05B 6/36

[52] U.S. Cl. ..... 219/10.79; 219/6.5; 219/8.5; 219/10.41; 219/10.491; 219/10.71; 219/10.75; 373/160; 373/162; 336/150; 336/187

[58] Field of Search ..... 219/10.79, 10.75, 6.5, 219/8.5, 10.41, 10.43, 10.47, 10.491, 10.492, 10.71; 335/187; 336/188, 150; 373/160, 162; 374/156

[56] References Cited

U.S. PATENT DOCUMENTS

| | | | |
|---|---|---|---|
| 1,986,353 | 1/1935 | Northrup | 219/10.79 |
| 2,249,909 | 7/1941 | Pisarev | 219/10.79 |
| 4,072,873 | 2/1978 | Nottingham | 310/71 |
| 4,176,237 | 11/1979 | Bingen . | |
| 4,277,768 | 7/1981 | Burgeson et al. | 336/228 |
| 4,820,892 | 4/1989 | Holmstrom et al. | 219/10.491 |
| 4,859,823 | 8/1989 | Faber | 219/10.79 |
| 4,864,266 | 9/1989 | Feather et al. | 336/150 |
| 4,874,916 | 10/1989 | Burke | 219/10.75 |

FOREIGN PATENT DOCUMENTS

| | | |
|---|---|---|
| 2347592 | 4/1974 | Fed. Rep. of Germany . |
| 1150187 | 8/1957 | France . |
| 1371223 | 7/1964 | France . |
| 2555353 | 5/1985 | France . |

*Primary Examiner*—Bruce A. Reynolds
*Assistant Examiner*—Tu Hoang
*Attorney, Agent, or Firm*—Sughrue, Mion, Zinn, Macpeak & Seas

[57] ABSTRACT

A cooling tube (T) is incorporated into each conductor (C1) of the coil. The current carried by this conductor is divided between the strands which are maintained in thermal contact with the tube even in transposition or twist areas in which the conductor undergoes particularly marked deformations. The conductor features at least one half-turn twist between the electrical terminals of the coil.

11 Claims, 4 Drawing Sheets

INDUCTIVE HEATING COIL

FIELD OF THE INVENTION

The present invention is generally concerned with electromagnetic induction heating. It applies in particular, although not exclusively, to heating the moving edges of flat metallurgical products to be deformed at raised temperature. This includes products of the iron and steel industry that have to be heated or reheated before they are flattened and/or widened by passing them between the rolls of a rolling mill.

BACKGROUND OF THE INVENTION

This heating is typically provided by a device comprising:

a magnetic circuit including an airgap, transport means for moving the product to be heated through the air gap, a coil surrounding said magnetic circuit in the vicinity of the air gap, a capacitive system typically comprising a battery of capacitors and connected to the winding to constitute a circuit which resonates at an operating frequency which is generally between 100 and 1 000 Hz and typically around 250 Hz, and an electrical generator feeding current into the resonant circuit at the operating frequency.

The presence of the capacitive system enables a current to be passed through the coil that is much higher than the current provided by the electrical generator. The latter then supplies only an active power that is actually consumed by the device, a "reactive" power of perhaps ten times this amount being provided by the capacitive system.

The product to be heated is often travelling at high speed and may feature irregularities which make it necessary to provide a wide gap. Also, the product temperature is often such that a thermally insulative layer must be provided to either side of the gap to protect the coil and the nearby electrotechnical equipment. As a result the airgap of the magnetic circuit must be large, which results in a high leakage of magnetic flux in the region of the coil. Part of this leakage flux is of no benefit for heating the product and induces current into the coil conductors which causes significant unwanted heating of said conductors.

To reduce this unwanted heating and to increase the energy efficiency of the device, in other words the ratio of the heating power developed by the current induced in the product to be heated to the active power supplied by the electrical generator, it is known:

to make the heating coil as compact as possible, to use for the electrical conductors of the coil a form that is sufficiently subdivided, given their electrical resistivity and the operating frequency, in other words giving them sufficiently small transverse dimensions, to reduce the generation of induced current in the metal mass of each conductor, multiple conductors being then grouped in parallel and insulated from each other except at their two ends where they are joined to two terminals common to all the conductors of a group, to transpose the conductors within the same group to reduce the induced current that may flow in a closed loop comprising two conductors and the two terminals of the group, and to cool the coil strongly using a cooling circuit to enable a high usable heating power to be applied by means of a compact coil.

For this reason one known heating coil comprises certain features which are, as to their function as explained hereinafter, common to this coil and to a coil in accordance with the invention, these common features comprising:

a ferromagnetic core, two electrical terminals adapted to receive an alternating current, a group of electrical conductors connected in parallel between the two electrical terminals, the group being in the form of a winding around said feromagnetic core, the conductors being transposed within the group so as to equalize approximately the various alternating ma fluxes enclosed by the respective conductors of the group, the transposition being achieved by means of transposition deformations of said conductors in transposition areas of said conductors, a cooling pipe around said core in thermal contact with said conductors, and hydraulic terminals for circulating a cooling fluid in said cooling pipe.

U.S. Pat. No. 4,176,237 describes an induction furnace for liquid metals. It is provided with an inductive heating coil comprising conductors connected in parallel between two electrical terminals of the coil, each of the conductors comprising a cooling tube, the current carried by the conductor being divided between strands in thermal contact with the walls of the tube, the length of the conductor including strongly deformed areas in is subject to particularly marked deformations which transpose conductors and strands to reduce the formation of unwanted current loops.

Known coils of this kind leave much to be desired with regard to their compactness, their cost and the energy efficiency of the heating device of which they form part.

One object of the present invention is to enable the simple manufacture of a compact heating coil which reduces the energy losses of an inductive heating device.

SUMMARY OF THE INVENTION

According to the invention, the current carried by each conductor of the coil is divided between strands in thermal contact with a cooling tube of the conductor even in transposition or twisting areas where the conductor undergoes particularly intense deformations, the conductor featuring at least one half-turn twist between the electrical terminals of the coil.

How the present invention may be put into effect will now be described by way of non-limiting example only with reference to the appended diagrammatic drawings in which the same component is identified by the same reference number if it appears in more than one figure.

DESCRIPTION OF THE PREFERRED EMBODIMENT

Figure 1:
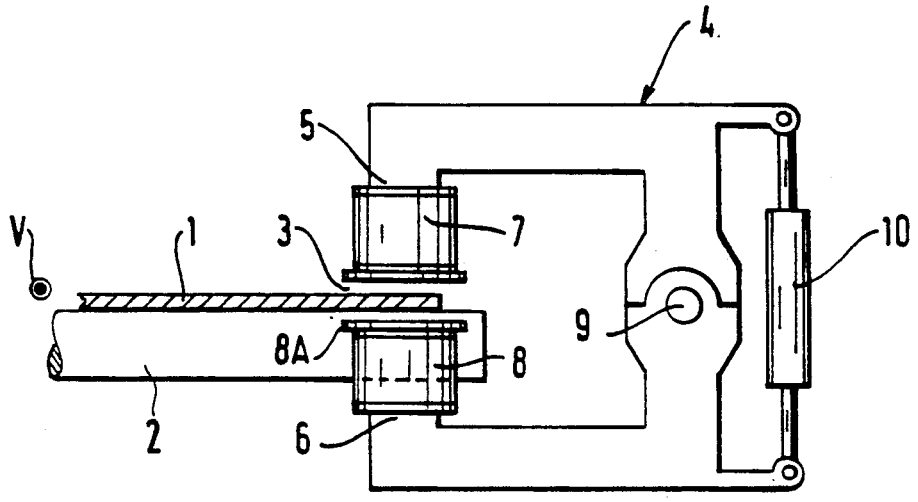
FIG. 1 shows an edge heating device in accordance with the invention incorporating two coils.

Referring to FIG. 1, an edge heating device is used in an iron and steelworks on the entry side of a rolling mill. A flat product in the form of a thick steel plate 1 runs on transport rollers 2 in a direction perpendicular to the plane of the drawing as shown by the end view of an arrow V.

It passes at high speed through the air gap of a magnetic circuit 4 whose two ends constitute the ferromagnetic cores 5 and 6 of two identical heating coils 7 and 8.

The coils are protected from the heat by insulative layers 8A, etc.

The magnetic circuit is hinged about an axis 9 to enable a device 10 to increase temporarily the size of the airgap 3 if the plate 1 features a projecting defect which could strike and damage one end of the magnetic circuit.

Figure 2:
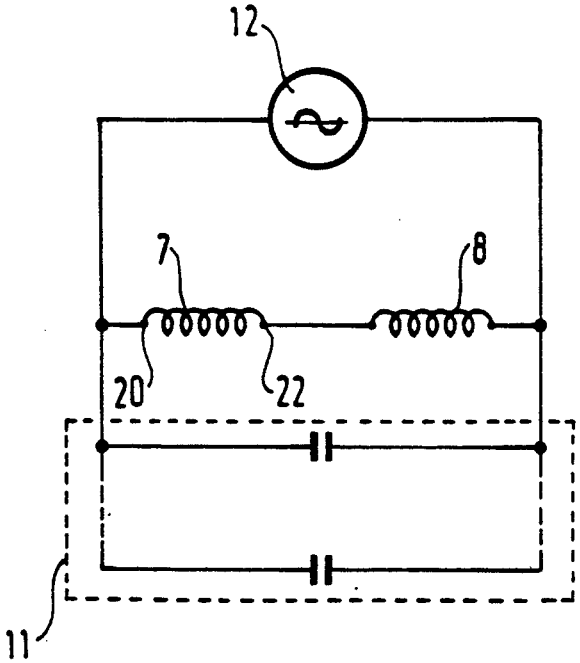
FIG. 2 is an electrical circuit diagram of the device.
Figure 3:
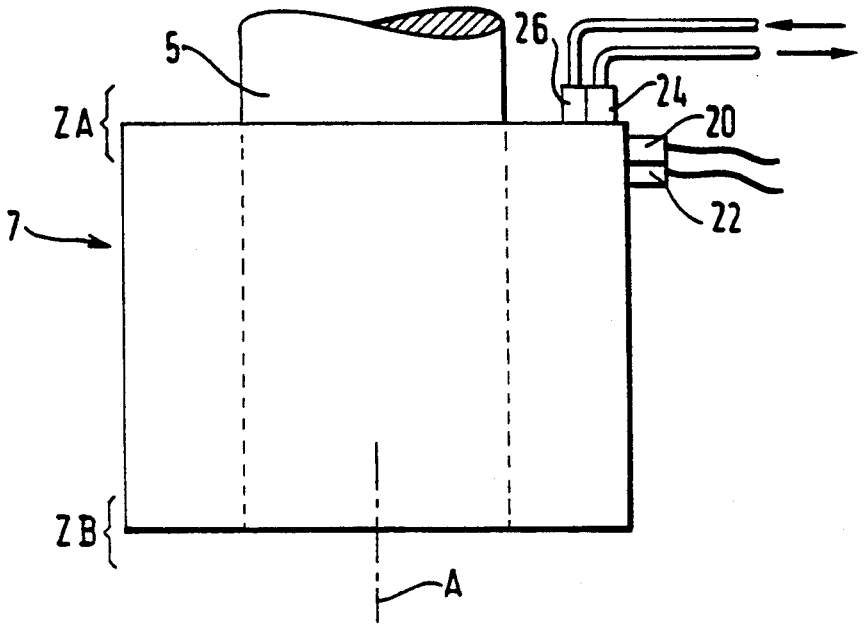
FIG. 3 is a general view in elevation of a coil from FIG. 1.
Figure 4:
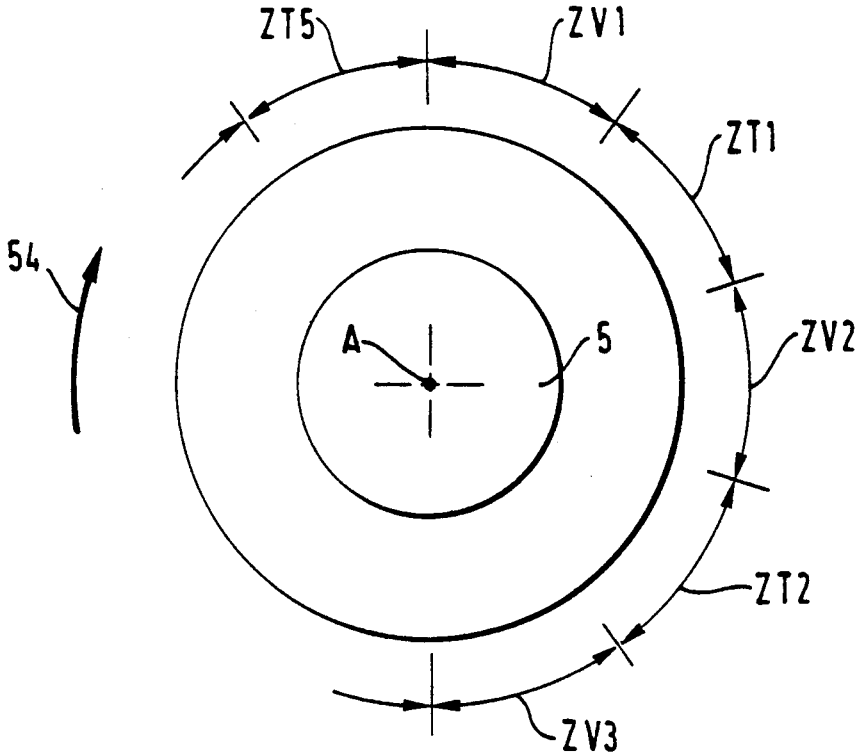
FIG. 4 is a bottom view of the coil from FIG. 3.

Referring to FIG. 2, the coils 7 and 8 are connected in series with each other and in parallel with a capacitive system 11 between the terminals of a generator 12. This supplies an alternating current voltage at an operating frequency of 250 Hz. The resonant circuit formed by the coils 7 and 8 and the capacitive system 11 is tuned to this frequency.

Various advantageous features of the coil 7 will now be described with reference to FIGS. 3 through 7. It must be understood that words such as top, bottom, up, down, above, below, etc are used purely to distinguish between different parts of the coil, without reference to the various orientations that the coil might have relative to the gravitational field in various heating devices.

The coil comprises:

a core 5 which is typically made from a ferromagnetic material and which extends along a coil axis A, two electrical terminals 20, 22 receiving an alternating current at an operating frequency of 250 Hz, and a group of electrical conductors connected in parallel between the two electrical terminals and wound around the core 5 conductors. The conductors are radially and axially transposed within the group and each conductor is twisted a half-turn around the conductor axis so as approximately to equalize the various alternating magnetic fluxes surrounded by the various conductors of said group. This embodiment requires "transposition" deformations to be applied to each of the conductors in a "transposition" section of the conductor. To cool it, the coil further comprises:

a cooling tube T incorporated into each of the conductors, and hydraulic terminals 24, 26 for circulating a cooling fluid in the cooling pipe.

In accordance with the present invention, each tube T has an external surface of which at least part constitutes a thermal contact surface 28 extending lengthwise of the tube. It is made from a material having sufficient electrical resistivity, given its transverse dimensions, to limit the current induced in this material at the operating frequency.

A plurality of current carrying strands B1 through B12 extends lengthwise of the tube T. They are made from an electrically conductive material which has an electrical resistivity lower than that of the material of the tube. Each has transverse dimensions which are less than those of the tube and which are chosen, given this lower resistivity, in such a way as to limit the current induced into the strand at the operating frequency. What is more, it performs at least one half-turn or twist around the axis of the tube between the two electrical terminals in order to achieve transposition of the strands within each conductor.

Some strands at least belong to a first layer of strands B1, B2, B3. They are applied to the thermal contact surface 28 of the tube in such a way as to achieve thermal contact without electrical contact.

Electrically insulating means 30 are provided to insulate the strands at least from each other between the electrical terminals together with connection means 32 which are sufficiently strong mechanically to maintain the strands in continuous thermal contact with said thermal contact surface, even in the transposition sections such as the area ZT1. Each conductor C1, etc comprises to this end a known type substance 30 that will be referred to hereinafter as an "internal resin" and which is selected to be electrically insulative, mechanically strong and strongly adherent to the tube T and to the strands B1 through B12. An electrically insulative and mechanically strong strip 32 surrounds the assembly comprising the tube T, the strands B1 through B12 and the internal resin 30. This strip is itself impregnated with a known type resin which can be different than the internal resin 30.

The tube T has a substantially rectangular flattened profile with two major surfaces 28, 36 extending widthwise of the tube and two lateral surfaces 38, 40 in the direction of the thickness of the tube, which is less than the width. Each of the two major surfaces constitutes one of the thermal contact surfaces. At least two strands such as the strands B1 and B2 of the first layer B1 through B3 are in thermal contact with each of the two major surfaces of the tube T. They are offset from each other widthwise of the tube. At least one twist of the conductor C1, etc is formed in a twist section ZV1, FIG. 4, etc which is specific to the conductor and which extends over a limited fraction of the latter's length. This twist is a half-turn twist of the conductor C1, about an axis 42 of the tube T so that each of the two major surfaces 28, 36 progressively takes the place of the other. In this way the strands B1 through B12 are transposed within each conductor. In this example the tube T is made from bronze and the strands B1 through B12 are made from pure copper.

Each of the strands B1, etc has a flattened substantially rectangular cross-section with two major surfaces 44, 46 extending widthwise of the strand parallel to the width of the tube T. The strand also has two lateral surfaces 48, 50 extending in the direction of the thickness of the strand which is smaller than the width of the strand and parallel to the thickness of the tube. Some of the strands constitute two first layers of strands B1 through B3 and B7 through B9 which are respectively applied to the two major surfaces 28, 36 of the tube T. Other strands constitute two second layers of strands B4 through B6 and B10 through B12 superposed on the first two layers in such a way as to obtain indirect thermal contact between the two major surfaces of the tube and the two second layers through the two first layers.

Each of the first and second layers comprises the same number of strands, between 2 and 5, inclusive. This number is preferably equal to 3, as shown in FIGS. 3 through 6.

Figure 5:
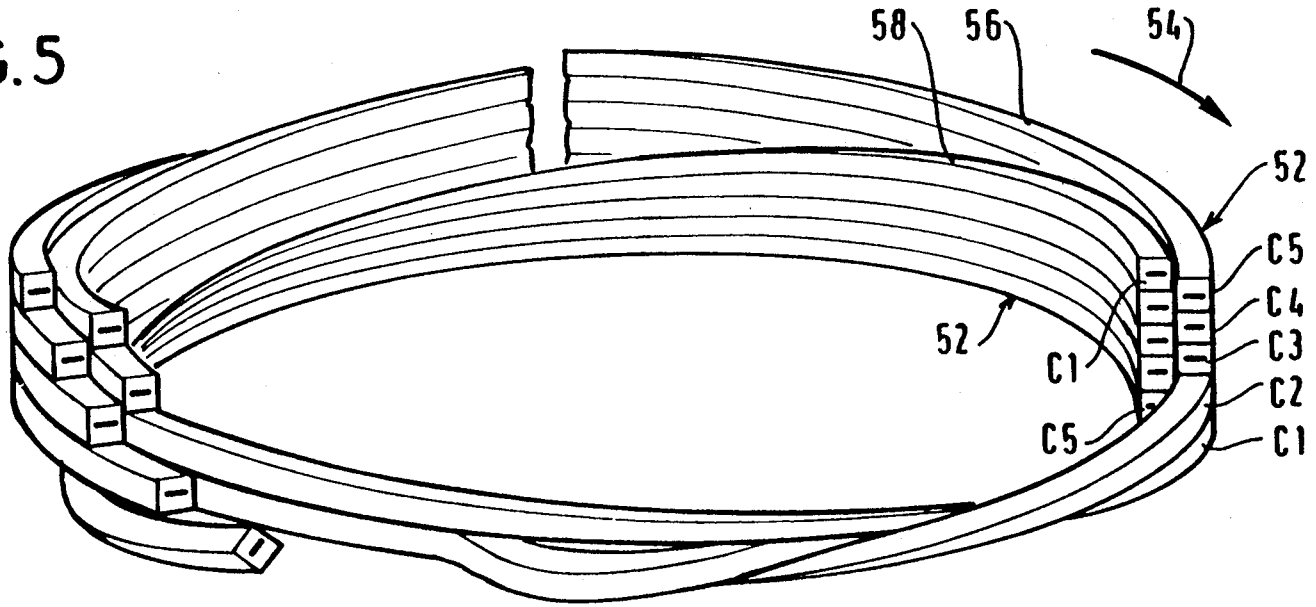
FIG. 5 is a partially cut away perspective view of a lower part of the coil.
Figure 6:
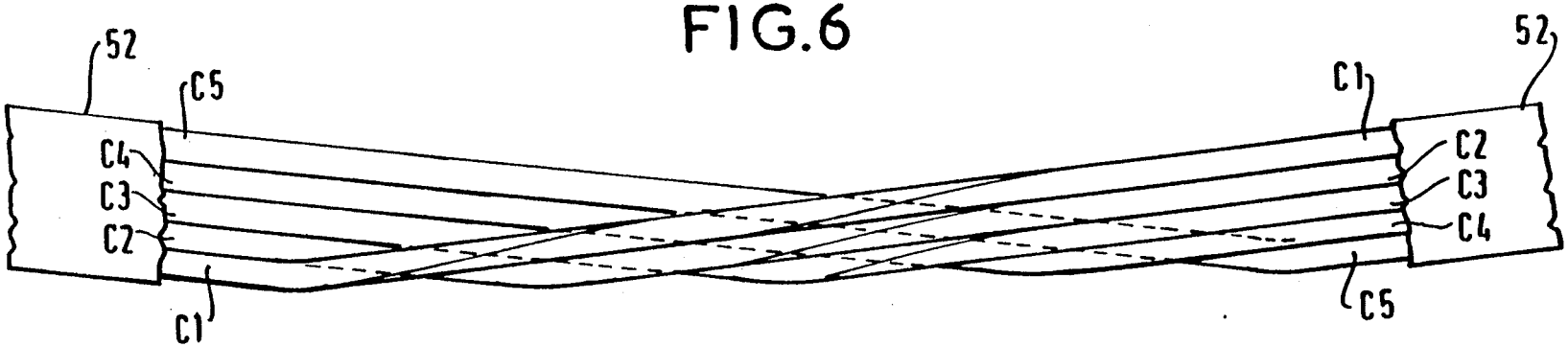
FIG. 6 shows one bar of said coil in said lower part developed in the flat.
Figure 7:
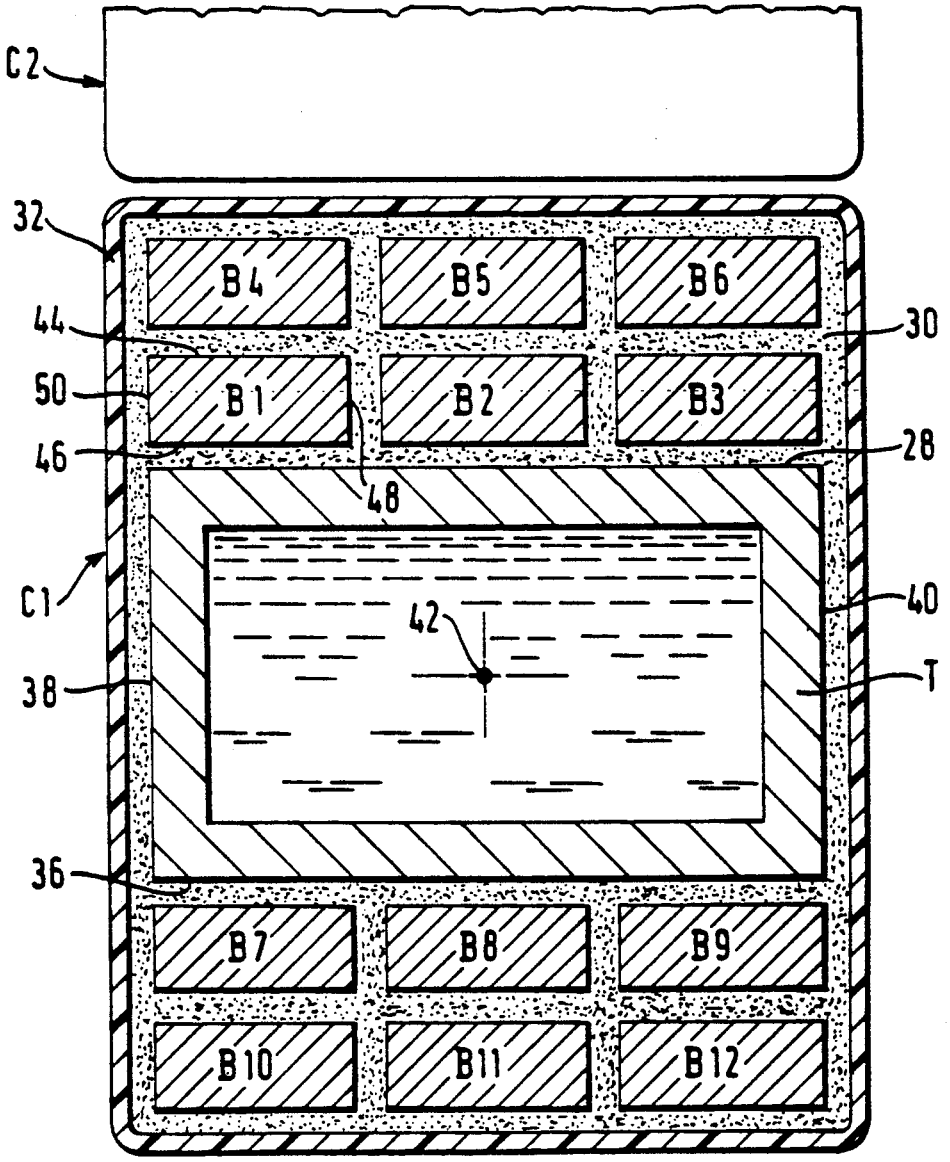
FIG. 7 shows a transverse cross-section of a conductor of the bar.

Each group of conductors constitutes a bar 52, FIG. 5, within which conductors C1 through C5 form a succession of coded turns in an axial direction parallel to the coil axis A.

The coil 7 extends in the axial direction between two circular end areas each sur the coil axis A. One of these areas comprises the electrical terminals 20,22 and constitutes an upper area ZA. The other constitutes a lower area ZB. There are two possible directions of vertical displacement: a downward direction from the upper area to the lower area and an opposite upward direction. The bar 52 starts from a first electrical terminal 20 and turns in a forward direction 54, FIG. 5, around the coil axis A and in a downward direction. It thus forms an external winding 56 having a first diameter. A first conductor C1 within this winding is at the bottom of the bar. A second conductor C2 is above the first conductor, and so on up to the last conductor C5 placed at the top of the bar over a penultimate conductor C4. This bar turns and descends within the winding until the first conductor C1 reaches the lower area ZB of the coil. The first conductor then undergoes a transposition deformation in the transposition area ZT1 of the conductor so that it joins an inner winding 58 formed by the same bar 52. This winding has a second diameter smaller than the first diameter and the bar 52 rises within it as it turns about the coil axis A, FIG. 4, in the forward direction.

The second conductor C2 in the external winding in turn reaches the lower section of the coil. It then undergoes the same transposition deformation in its own transposition area ZT2 which is offset angularly in the forward direction from the transposition section of the first conductor, FIG. 3. This deformation causes the second conductor to join the inner winding 58 on passing under the first conductor C1, and so on until the final conductor C5 reaches the lower section ZB of the coil. This latter conductor then undergoes the same transposition deformation in a transposition section ZT5, FIG. 4, offset angularly in the same direction from a transposition section ZT4 of the penultimate conductor C4. This transposition deformation causes the conductor C5 to join the internal winding on passing under the penultimate conductor. As a result the first conductor C1 is positioned within the internal winding 58 at the top of the bar 52, the second conductor C2 under said first conductor, and so on up to the final conductor which is at the bottom of the bar. The latter turns and rises within the winding to the second electrical terminal 22 in the upper section ZA FIG. 3, of the coil.

In the coil described by way of example there are five conductors in a bar and the thicknesses of the tube and of the strands of each conductor are oriented in the axial direction. The twisting sections ZV1 through ZV5 are disposed alongside the transposition section ZT1 through ZT5, FIG. 4, in order to form regular angular successions about the axis A.

One object of the present invention is a method of manufacturing an inductive heating coil of this kind. This method comprises the following known operations:

fabrication of a group of conductors 52 made up of deformable electrical conductors C1 through C5, fabrication of a deformable cooling pipe T, fabrication of a ferromagnetic core 5, winding of the group of conductors around the core including application to said conductors of relatively moderate winding deformations, transposing said conductors within said group, said transposition accompanying said winding operation and being achieved by transposition deformations applied locally to said conductors, winding the cooling pipe around the core, fitting electrical terminals 20, 22 to the ends of the group of conductors, and fitting hydraulic terminals 24, 26 to the ends of the cooling pipe.

This method is characterized by the combination of the operations of fabricating a group of conductors 52 and a cooling pipe carried out as follows:

fabrication of a tube T constituting the cooling pipe and having an external surface of which at least a part constitutes a thermal contact surface 28 extending lengthwise of the tube and is made from a material having a relatively higher electrical resistivity, fabrication of current carrying strands B1 through B12 having transverse dimensions less than those of the tube and made from a material having an electrical resistivity lower than that of the material of the tube, and connection of the strands to the tube by means of connecting means 32 which provide continuous thermal contact between said tube and said strands without causing electrical contact between said strands or between the strands and the tube, by connecting means being chosen to mechanically maintain the continuity of the thermal contact even when the transposition deformations are created in the conductor.

We claim:

1. In an inductive heating coil comprising a plurality of electrical connectors forming a group and being connected in parallel between tow electrical terminals of said coil, each of said conductors comprising:

a cooling tube for carrying a cooling fluid, and strands for carrying electrical current, said strands being connected in parallel between said terminals of said coil and being in thermal contact with walls of said tube, said conductors including deformations along a length of said conductors, with said conductors being transposed in said coil, and said strands being transposed in each conductor to reduce a formation of unwanted current loops;

the improvement wherein positions of said strands relative to the walls of said tube and relative to each other in a cross-section of said each conductor are substantially unchanged over a complete length of each said conductor, and said transposition between said strands being locally effected by a twist of at least one half-turn of each said conductor about a conductor axis in at least one marked deformation section of limited length of each said conductor.

2. Inductive heating oil according to claim 1 for heating moving metallurgical flat products to be deformed at raised temperature, said plurality of electrical conductors form a winding around a coil axis, said conductors are transposed within said group by transposition deformations in markedly deformed transpositions sections of said conductors, a cooling tube is incorporated into each of said conductors having a thermal contact surface extending lengthwise of said cooling tube and said cooling tube being made of a material of relatively high electrical resistivity, wherein said plurality of current carrying strands extend lengthwise of said tube of an electrically conductive material having an electrical resistivity lower than that of said material of said tube, each of said strands having transverse dimensions less than transverse dimensions of said tube, each of said strands is twisted at least one half-turn around the axis of the tube to transpose said strands within each said conductor, at least several of said strands forming a first layer of strands applied to said thermal contact surface of said tube to effect thermal contact therewith, without electrical contact, electrical insulation means for insulting said strands from each other between said electrical terminals, connecting means for holding said strands near said thermal contact surface, and hydraulic terminals connected to said cooling tube for circulating a cooling fluid in said cooling tube, and said connecting means acting to mechanically maintain substantially the respective positions of said strands and of said tube in said markedly deformed sections unchanged.

3. Inductive heating coil according to claim 2 wherein each conductor incorporates an internal resin constituting at least part of said electrical insulating means and said connecting means.

4. Inductive heating coil according to claim 3 wherein said connecting means comprises an electrically insulative strip surrounding a combination of said tube, said strands and said internal resin.

5. Inductive heating coil according to claim 2 wherein said tube has a flattened substantially rectangular cross-section with two major surfaces extending over a width of said tube, and tow lateral surfaces extending over a thickness of said tube, and the thickness being smaller than the width, each of said two major surfaces constituting a thermal contact surface, at least two of said strands of said first layer of strands being in thermal contact with each of said tow major surfaces of said tube and being offset relative to each other widthwise of said tube.

6. Inductive heating coil according to claim 5 wherein each of said strands has flattened substantially rectangular cross-section with two major surfaces extending over a width of said strand parallel to said width of said tube, each of said strands also having tow lateral surfaces extending in the direction of a thickness of said strand, the thickness of each strand being smaller than said width of said strand and the lateral surfaces of said strand extending parallel to the thickness of said tube, a plurality of said strands constituting said two first layers of strands applied respectively to said tow major surfaces of said tube, a further plurality of said strands forming two second layers of strands superposed respectively on said two first layers of strand in indirect thermal contact with said two major surfaces of said tube through said two first layers of strands.

7. Inductive heating coil according to claim 6 wherein each of said first and second layer of strands are of the same number, which number is between two and five inclusive.

8. Inductive heating coil according to claim 2 wherein each group of conductors constitutes a bar formed of a succession of said conductors in an axial direction parallel to said coil axis, said coil extends in said axial direction between said two circular end areas of said coil constituting an upper area and a lower area, said electrical terminals being proximate to said upper area, said bar starting from a first one of said electrical terminals, turning in a forward direction around said coil axis and extending downwards to form an exterior winding of a first diameter, and including a first one of said conductors placed in said winding at a bottom of said bar, a second of said conductors being placed over said first conductor and additional of said conductors being placed in sequence over said first conductor and said second conductor up to last of said conductors at a top of said bar, said bar further turning and descending in said winding in the direction of the lower area of the coil until said first conductor reaches aid lower area, said first conductor having at least one of said transposition deformations in said transposition section of said conductor and joining an inside winding formed by said bar of a second diameter smaller than said first diameter, said bar rising within said inside winding and turning around said coil axis in said forward direction and including a second done of said conductors in said external winding reaching said lower area of said coil and including one of said transpositions deformations in a transposition zone of said second conductor offset angularly in said forward direction from said transposition section of said first conductor, said transposition deformation of said second conductor causing said second conductor to join said internal winding by passing under said first conductor of said exterior winding, and continuing until a last of said conductors reaches said lower are of said coil, said last conductor including a said transposition deformation in a transposition section of said last conductor offset angularly in said forward direction from a transposition section of a penultimate one of said conductors, said transposition deformation of said penultimate conductor causing said last conductor to join said internal winding by passing under said penultimate conductor so that said first conductor is placed in said internal winding at the top of said bar, said second conductor extending under said first conductor and so on in a sequence of said conductors such that the last conductor is placed at the bottom of said bar, and said bar turning and rising within said winding to said second electrical terminal in said upper section of said coil.

9. Inductive heating coil according to claim 8 wherein the twisting section of each of said conductors is adjacent said transposition section of said each conductor.

10. Inductive heating coil according to claim 8 wherein said tube has a flattened substantially rectangular cross-section with two major surfaces extending widthwise of said tube and two lateral surfaces extending in the direction of a thickness of said tube which thickness is smaller than said width, each of said tow major surfaces constituting a thermal contact surface, at least two of said strands of said first layer being in thermal contact with each of said two major surface of said tube and being offset relative to each other widthwise of said tube.

11. Method of manufacturing an inductive heating coil comprising the following operation:

fabricating a plurality of conductors by, for each conductor, fabricating a cooling tube having an external surface, a part of which at least constitutes a thermal contact surface extending lengthwise of said tube which is made of a material having a relatively high electrical resistivity, fabricating current carrying strands having transverse dimensions less than transverse dimensions of said tube and made from a material having an electrical resistivity less than that of said material of said tube, connecting said strands to said tube by means of connecting means providing continuous thermal contact between said tube and said strands without producing electrical contact between said strands or between said strands and said tube, forming a group of said conductors, winding said group of conductors coil-fashion so that said conductors undergo relatively moderate winding deformations, transposing said conductors within said group and said strands within each conductor, with said transpositions accompanying said winding and effected by relatively marked deformations locally along a length of said conductors, fitting electrical terminals to the ends of said group of conductors, and fitting hydraulic terminals to the ends of said group of conductors, and fitting hydraulic terminals to the ends of said cooling tubes, the improvement wherein the operation of transposing said strands within said conductors is effected solely by twisting said conductors by at least one half-turn about the axis of each of said conductors, and said connecting means mechanically maintains the continuity of thermal contact during the operation of effecting said marked deformations to said conductors.

* * * * *